United States Patent [19]

Jiruse

[11] 4,205,606

[45] Jun. 3, 1980

[54] CONTROL MECHANISM FOR GRIPPERS OF A SHEET DELIVERY DEVICE

[75] Inventor: Jaroslav Jiruse, Blansko, Czechoslovakia

[73] Assignee: Adamovske Strojirny, Narodni Podnik, Adamov, Czechoslovakia

[21] Appl. No.: 886,637

[22] Filed: Mar. 15, 1978

[30] Foreign Application Priority Data

Mar. 21, 1977 [CS] Czechoslovakia ..... 1828-77

[51] Int. Cl.[2] ..... B41F 13/64

[52] U.S. Cl. ..... 101/240; 271/206

[58] Field of Search ..... 101/240, 236, 238; 271/64, 204, 198-201, 206

[56] References Cited

U.S. PATENT DOCUMENTS

| | | | |
|---|---|---|---|
| 1,638,752 | 8/1927 | Sheldrick | 101/240 |
| 3,610,579 | 10/1971 | Jiruse | 271/206 |

*Primary Examiner*—Paul T. Sewell
*Assistant Examiner*—A. Heinz
*Attorney, Agent, or Firm*—Burgess, Ryan and Wayne

[57] ABSTRACT

A control mechanism for grippers of a sheet delivery device particularly on a printing machine, is disclosed. A chain delivery device is provided with a gripper mechanism whereby printed paper sheets coming from a printing unit are grabbed by the grippers, then carried to a delivery area at which point the grippers are opened and the paper sheets are released by the grippers and fall onto a pile of sheets.

3 Claims, 3 Drawing Figures

1
2
3
3
5
6
7
8
9
10
11
12
13
14
15
16
17
18
19
20
23
23
24
25
26
26
27
28
29
30
31
32
33
34
35
36

CONTROL MECHANISM FOR GRIPPERS OF A SHEET DELIVERY DEVICE

The invention relates to a control mechanism for grippers of a sheet delivery device, particularly on a printing machine. A chain delivery device is provided with a gripper mechanism by which the printed paper sheets coming from a printing unit are seized by the grippers and are carried to a delivery table, where the grippers are opened and the paper sheets are released by the grippers and fall on a pile of sheets.

The object of the present invention is to provide a control mechanism for the grippers of a sheet delivery device, whereby printed paper sheets are carried from a printing unit by grippers in such a way as to be released at a convenient spot, at which point, the paper sheets fall on a pile of sheets located on a delivery talbe of the machine.

When the printing speed of the printing machine is changed, it is necessary to change the location where the paper sheets must be released by the grippers to fall on the top of the pile. The paper sheets must be released by the grippers in the proper place to form an accurate pile of sheets. Further, the control mechanism must have a simple structure which can be easily operated and also adjusted by an operator to accommodate different weights and quality of the printed sheets.

One of the known devices for releasing paper sheets from grippers is designed so that on a fixed eccentric pivot, there is adjustably mounted a control cam which is connected by means of a connecting link with a cam segment which is turnably arranged on a shaft. The control cam is provided with a gear which engages a regulating pinion. The setting of the control mechanism to provide release of the paper sheets by the grippers on the pile of sheets is carried out manually by turning the regulating pinion which shifts the control cam.

A disadvantage of the above described device is that for each change of speed of the printing machine, the control mechanism for the grippers must be adjusted to provide an accurate pile of printed sheets. The necessity to adjust the gripper control mechanism is a great disadvantage with machines which are provided with an automatic mechanism for setting the printing speed. The change of the printing speed is carried out very quickly and the operator cannot find the necessary time to adjust the control mechanism for the gripper operation. As a result, the sheets become defined in the delivery device and cannot be properly stacked.

Another known device is arranged in such a way that the adjustment of the control cam for the grippers to release the paper sheets is achieved electromechanically and is derived from an electromotor, the rotations of which are regulatable.

The disadvantage of a device in which adjustment of the control cams is achieved electromechanically is that it cannot be used with printing machine which have a built-in mechanical variator.

Another disadvantage of said device is that it does not enable a change in the location of the paper release by the grippers and to regulate the mechanism in relation to the weight and the quality of the paper sheets.

The above disadvantages are avoided by the control mechanism of the present invention, wherein a control cam is fixed on a holder which is shiftably arranged on a guide, and adjustably mounted on a control screw, on which is further mounted a carrier which is connected by means of a carrier pivot with a carrier lever fixed on a pivot, this pivot being turnably mounted in a side wall of the printing machine and being on one end provided with a swing lever which is rigidly connected with a variator. On the side wall of the printing machine, there are attached holders in which a guide is fixed and further there is turnably and shiftably mounted the control screw, on which a carrier is arranged and is axially secured by means of its shoulder and a securing ring. The holder is mounted on the control screw between two stop rings whereby said stop rings are mounted on the control screw between two holders.

The advantage of the control mechanism of the invention is that it provides an accurate release of the paper sheets by the grippers, so that the paper sheets fall on the pile which is placed on the delivery table of the printing machine. When the printing speed of the machine is changed, the control mechanism automatically adjusts the location of the release of the sheets of paper by the grippers so that the sheets of paper will be properly stacked on the receiving table of the printing machine at the new printing speed of the machine. The location of the paper release is automatically adjusted since the position of the control cam is directly derived from the position of the variator.

Another advantage of the control mechanism of the present invention is that its setting to accommodate different weight and quality of paper sheets can be done quickly and easily by the operator. The mechanism is simple in structure and inexpensive to produce.

A further advantage of the mechanism according to the invention is the reliability of the arrangement, which reduces failure in operation of the printing machine.

A specific embodiment of the invention will now be described by way of example with reference to the accompanying drawings, in which.

Figure 1:
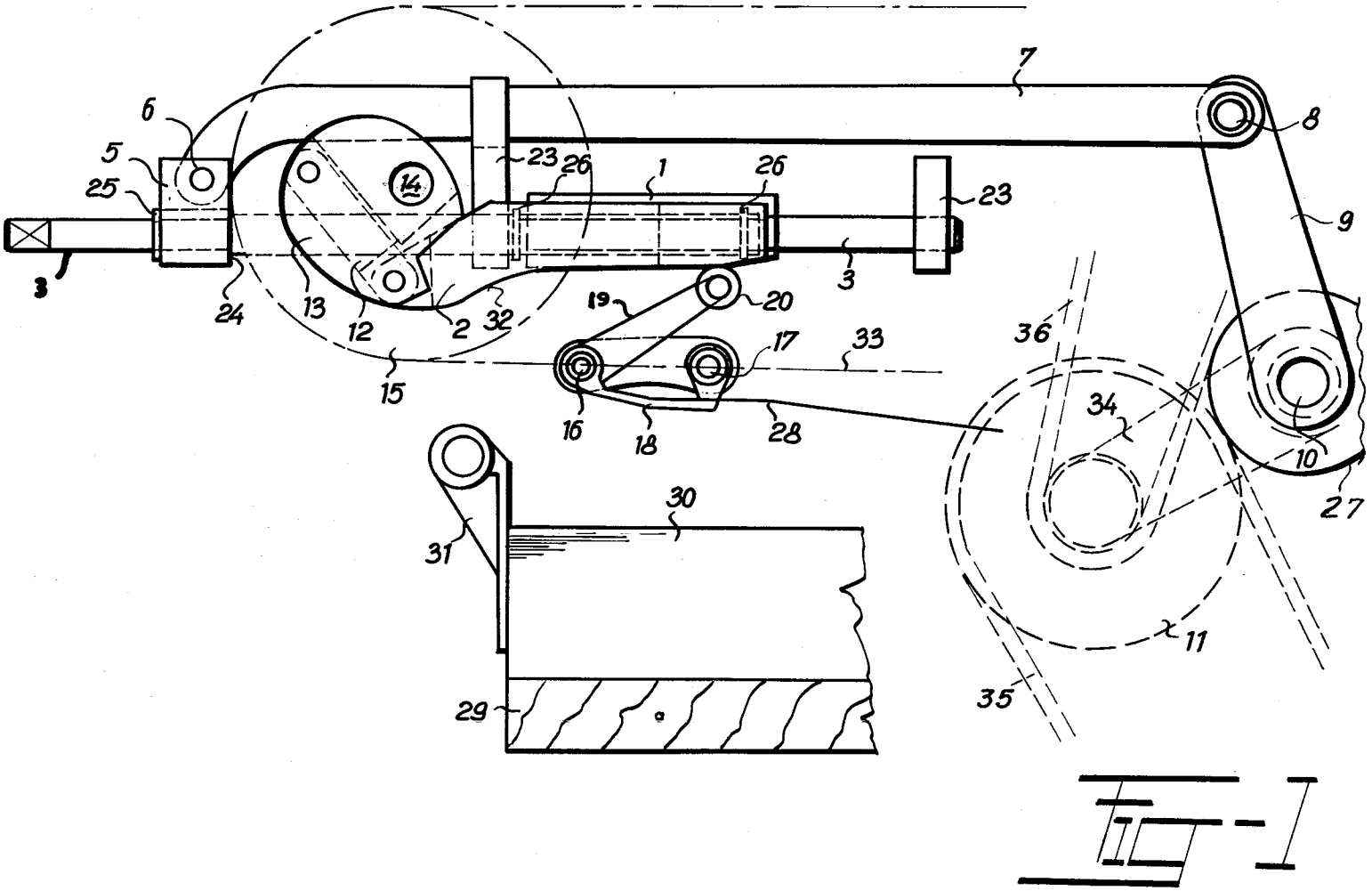
FIG. 1 shows a front elevation of the control mechanism in a position when the printing machine runs at minimum speed.
Figure 2:
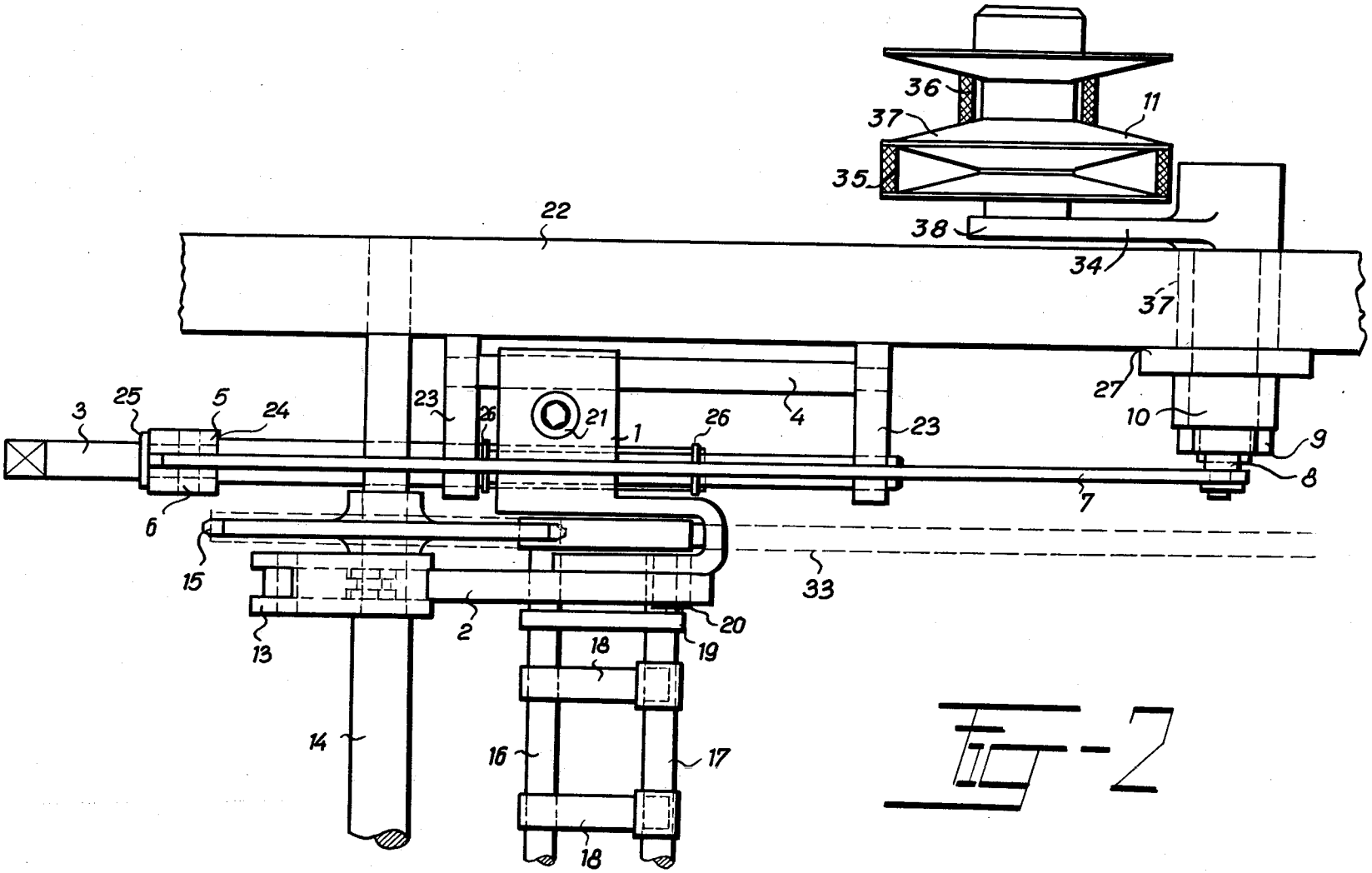
FIG. 2 is a plan view of the control mechanism of FIG. 1.

The control mechanism for the grippers of a sheet delivery device according to the invention comprises a holder 1, on which is fixed a control cam 2 which is connected by means of pivots and connecting elements 12 with a cam segment 13. The cam segment 13 is turnably mounted on an axis 14, on which also is mounted a chain wheel which engages with endless chains 33. On the endless chains 33 is attached a first carrier rod 16 and a second carrier rod 17. On the second carrier rod 17 are arranged stop elements on which abut the seizing parts of the grippers 18. The holder 1 is shiftably mounted on guide 4, and adjustably mounted on control screw 3. The guide 4 is mounted on holders 23 which are fixed on the side wall 22 of the printing machine. The control screw 3 is freely mounted on a carrier 5 which bears with one end on a shoulder 24 which is formed on the control screw 3. The carrier 5 is axially secured on the control screw 3 by means of a securing ring 25. The control screw 3 is provided with stop rings 26 which limit the axial movement of holder 1 and axial movement of the control screw 3. The holder 1 is provided with a clamping screw 21 for limiting the play required for shifting of holder 1 on guide 4. The carrier 5 is connected by means of pivot 6 with one end of pull rod 7 which is connected at the other end with carrier lever 9 by means of carrier pivot 8. Carrier lever 9 is attached at one end to pivot 10 which is turnably mounted in a sleeve 27 affixed in the side wall 22 of the printing machine. The pivot 10 on the other end is rigidly connected with a swing lever 34 which is fixed to a variator 11 at the outer end 38 of swing arm 34 for achieving a stepless change of rotations. On the lower part of control cam 2 there is formed a surface 32, on which rolls a follower roller 20 which is mounted on lever 19. On a sheet delivery table is a pile 30 of sheets 28 which abut to the front stops 31 and in this way are properly stacked on the pile.

Figure 3:
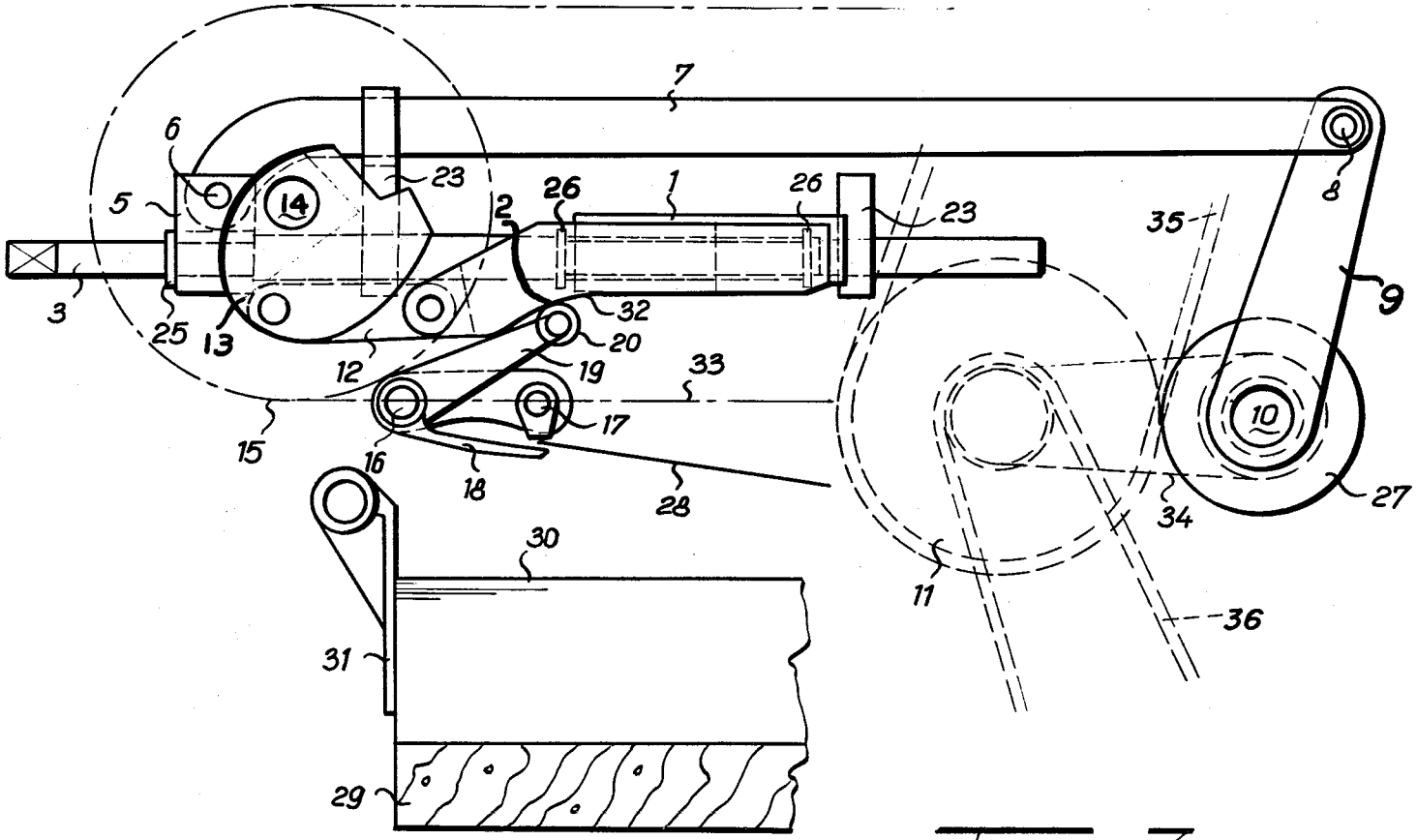
FIG. 3 illustrates a front elevation of the control mechanism in a position when the printing machine runs at maximum speed.

The variator 11 is a commonly used term for a variable speed transmission which enables a continuous change of rotations and working speed of a device such as a printing machine by means of adjustable pulleys which are provided with a groove for receiving the driving V-belt. By shifting the middle cone or flage 37 of the pulley of variator 11 in the axial direction the belts 35 and 36, which drive the printing machine, ride higher or lower in the V-grooves of the pulleys, thereby changing the speed of operation of the printing machine. This changes the effective lengths of the belts between pulleys 35 and 36 and the driving and driven pulleys (not shown). To compensate for this change, and to keep the belts taut, the variator itself must shift its position which can be seen by comparing FIG. 1 with FIG. 3.

When the V-belt runs on the changed diameter part of the pulley, and the position of the variator changes, simultaneously the swing lever 34 which pivots with the pivot 10 is swung out, the variator being mounted on one end of said swing lever. The change of position of the variator 11 (again, compare FIG. 1. with FIG. 3) and the swing lever 34 also turns the pivot 10, which pivots the carrier lever 9 to change the position of pull rod 7 and the carrier 5. Displacement of carrier 5 axially shifts the position of control screw 3 which is guided in holders 23. By shifting of control screw 3, the position of holder 1 with respect to the control cam 2 is shifted.

On the axis 14 is rotatably mounted the chain wheel 15 which engages with endless chains 33. The chain wheel 15 does not cooperate with the cam segment 13.

The control cam 2 is connected by means of pivots with one end of a connecting element 12 which is connected at its other end with the cam segment 13.

While shifting of the control cam 2, the connecting element 12 is also shifted away from the can segment 13, which turns on the axis 14.

The control mechanism according to the invention works in the following manner:

The paper sheets 28 which are delivered from the printing unit are seized by grippers 18 and are brought by means of the chain delivery mechanism on the sheet delivery table 29. The follower roller 20 moves along the surface 32 of control cam 2 and as a result the grippers 18 are opened and release the sheets of paper 28 which fall on the pile 30. The change of location for releasing the sheets of paper 28 is achieved by the axial setting of control cam 2 which is done in relation to the weight and quality of the paper sheets 28, according to the printing speed of the printing machine.

The location for release of the paper sheets by grippers 18 according to weight and quality of the sheets is set by turning the control screw 3. By turning control screw 3, holder 1 is shifted on the guide 4 in the range determined by the limiting stop rings 26 which are fixed on the control screw 3. Simultaneously control cam 2 is shifted with holder 1. Control cam 2 carries with it the connecting element 12 which is connected to cam segment 13. The adjustment is carried out by the operator of the printing machine when the machine is working at minimum speed while setting the passing of the paper sheets through the printing machine. According to the printing speed of the printing machine, the control mechanism is set in such a way that by the change in the position of the variator 11 and the movement of the swing lever 34, the pivot 10 is turned, which changes the position of the carrier lever 9. Changing the position of carrier lever 9 changes the position of lever 7 and the carrier 5. Displacement of carrier 5 axially shifts the position of control screw 3 which is guided in holders 23. By the shifting of control screw 3, the position of holder 1 with the control cam 2 is shifted. With every change of the printing speed of the printing machine, the place of release of the printed paper sheets 28 by the grippers is changed in such a way to provide for proper stacking of the printed sheets.

This change of the place for the release of the delivered paper sheets 28 by the grippers is carried out automatically, without manual assistance of the operator.

| List of Reference Numerals of Parts | |
|---|---|
| 1-Holder | 26-stop ring |
| 2-Control cam | 27-sleeve |
| 3-Control screw | 28-paper sheet |
| 4-guide | 29-sheet delivery table |
| 5-carrier | 30-pile |
| 6-pivot | 31-front stop |
| 7-pull rod | 32-functional surface of control cam |
| 8-carrier pivot | 33-endless chain |
| 9-carrier lever | 34-swing lever |
| 10-pivot | |
| 11-variator | |
| 12-connecting element | |
| 13-cam segment | |
| 14-carrying axis/shaft | |
| 15-chain wheel | |
| 16-first carrier rod | |
| 17-second carrier rod | |
| 18-gripper | |
| 19-lever | |
| 20-follower roller | |
| 21-clamping screw | |
| 22-side wall of the machine | |
| 23-holder | |
| 24-shoulder | |
| 25-securing ring | |

What is claimed is:

1. An automatic control mechanism for grippers with a control cam on a sheet delivery device, particularly on a printing machine, responsive to changes in speed of the printing machine, wherein the paper sheets delivered from the printing unit are carried by grippers to a sheet delivery table and are released by the grippers to be stacked on a pile of sheets, which comprises a control cam fixed on a holder which is shiftably mounted on a guide, and adjustably mounted on a control screw; a carrier arranged on said control screw to allow turning of said control screw but to prevent axial movement of said control screw with respect to said carrier; a pull rod pivotally mounted at one end to said carrier and at the other end to one end of a carrier lever which is turnably mounted at its other end on a pivot means in a side wall of the printing machine, said pivot means being provided at one end with a swing lever which is fixed to a variator, said variator having a moveable pulley member for varying the driving speed of the printing machine and being arranged to rotate said pivot means responsive to changes in the speed of said printing machine, thereby causing said carrier lever to pivot, changing the position of said pull rod, said carrier and said adjusting screw, whereby the position of the paper release is changed in relation to a change in speed of operation of the printing machine by means of said variator.

2. A control mechanism according to claim 1, wherein said control screw is turnably and shiftably mounted in holders on the side wall of the printing machine and said control screw has mounted thereon said carrier secured by a shoulder and a securing ring.

3. A control mechanism according to claim 1 wherein the holder is placed on the control screw between two stop rings, whereby said stop rings are mounted on the control screw between the two holders.

* * * * *

UNITED STATES PATENT OFFICE

CERTIFICATE OF CORRECTION

Patent No. 4,205,606 Dated June 3, 1980

Inventor(s) Jaroslav Jiruse

It is certified that error appears in the above-identified patent and that said Letters Patent are hereby corrected as shown below:

Column 1, line 18: "talbe" should be --table--.

Column 3, line 50: "can" should be --cam--.

Signed and Sealed this

*Eighteenth* Day of *November 198*

[SEAL]

*Attest:*

SIDNEY A. DIAMOND

*Attesting Officer* *Commissioner of Patents and Trademar*